US006648076B2

(12) United States Patent
Broome

(10) Patent No.: US 6,648,076 B2
(45) Date of Patent: Nov. 18, 2003

(54) GRAVEL PACK EXPANDING VALVE

(75) Inventor: John Todd Broome, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/934,061

(22) Filed: Aug. 21, 2001

(65) Prior Publication Data

US 2002/0066578 A1 Jun. 6, 2002

Related U.S. Application Data

(60) Provisional application No. 60/231,287, filed on Sep. 8, 2000.

(51) Int. Cl.[7] ..... E21B 34/14

(52) U.S. Cl. ..... 166/386; 166/317; 166/318; 166/332.4; 166/51; 166/205

(58) Field of Search ..... 166/373, 277, 166/386, 227, 332.4, 332.6, 334.4, 317, 318, 51, 205

(56) References Cited

U.S. PATENT DOCUMENTS

| | | | | | |
|---|---|---|---|---|---|
| 3,067,819 | A | * | 12/1962 | Gore | 166/387 |
| 3,191,677 | A | | 6/1965 | Kinley | 166/14 |
| 3,746,091 | A | * | 7/1973 | Owen et al. | 166/107 |
| 5,174,379 | A | * | 12/1992 | Whiteley et al. | 166/278 |
| 5,337,809 | A | | 8/1994 | Messenger | 166/208 |
| 5,390,742 | A | | 2/1995 | Dines et al. | 166/297 |
| 5,833,001 | A | | 11/1998 | Song et al. | 166/287 |
| 6,450,261 | B1 | * | 9/2002 | Baugh | 166/277 |
| 6,478,091 | B1 | * | 11/2002 | Gano | 166/373 |
| 2001/0020532 | A1 | * | 9/2001 | Baugh et al. | 166/285 |
| 2002/0079100 | A1 | * | 6/2002 | Simpson et al. | 166/278 |
| 2002/0108755 | A1 | * | 8/2002 | Zisk, Jr. | 166/369 |
| 2002/0145281 | A1 | * | 10/2002 | Metcalfe et al. | 285/206 |

* cited by examiner

*Primary Examiner*—Hoang Dang
(74) *Attorney, Agent, or Firm*—Madan, Mossman & Sriram, P.C.

(57) ABSTRACT

Circulation flow apertures in a wellbore pipe, tubing, casing or casing liner screen may be selectively closed by an internal pipe sleeve that is formed of a thin, malleable material. One axial end of the sleeve is flared and secured to the inner bore surface of the pipe as by welding or by clamping between the ends of axially adjacent pipe joints joined by a threaded coupling. The remaining length of the sleeve extends along the pipe and over any pipe apertures to form an annular space between the outer cylinder surface of the sleeve and the inner bore surface of the pipe. A perimeter seal element such as an O-ring is placed around the sleeve outer perimeter beyond the apertures in a direction opposite from the sleeve flare. The flow aperture in the pipe is closed by a swaging tool that expands the sleeve against the pipe bore wall sufficiently to close the annulus and compress the O-ring seal against the pipe borewall.

22 Claims, 4 Drawing Sheets

GRAVEL PACK EXPANDING VALVE

CROSS REFERENCE TO RELATED APPLICATIONS

This application claims priority from U.S. Provisional Patent Application Serial No. 60/231,287 filed on Sep. 8, 2000.

BACKGROUND OF THE INVENTION

1. Field of the Invention

The present invention relates to the earthboring arts. More particularly, the invention relates to apparatus and methods for petroleum well completion and preparation of a well for petroleum fluid production.

2. Description of Related Art

Pursuant to one procedure of petroleum well completion, after the well borehole is complete, an outer well casing is set within a cement annulus between the raw borehole wall and the outer surface of the casing pipe. Thereafter, the casing pipe and cement annulus are perforated into the formation production zone to provide petroleum fluid flow channels from the formation past the cement and pipe wall into the interior bore of the casing.

Although the cemented casing substantially stabilizes the formation production face, substantial quantities of formation debris may nevertheless be produced through the perforations. To suppress the transfer of formation debris into production flow tubing, it has become a practice to set a liner casing within the outer casing. Along the zone of petroleum production, the liner casing includes perforated pipe sections called screens. The screens may, in fact, be sections of pipe that are slotted with numerous, narrow slits or drilled with numerous small holes. Additionally, an annular space around the screens between the inner bore of the outer casing and the outer surface of the liner casing is packed with relatively large particulates to provide a gravel bed filter ahead of the screens.

In a related completion practice, the petroleum production flow rate from relatively narrow production zones is enhanced by drilling the wellbore along the zone strata to increase the production face area. In some cases, this practice may require the wellbore to follow a substantially horizontal directional course. Placing a gravel pack around the casing liner screens of a horizontal production face becomes a serious challenge due to an inadequacy of circulation fluid flow area. As the gravel is flowed into the inner annulus for well deposit between the screens and the casing perforations, a threshold flow velocity must be maintained to transport the gravel aggregate in a fluidized suspension to all regions of the gravel pack annulus. However, the fluid suspension medium that carries the gravel into the gravel pack annulus must pass through the screens in return circulation. At the threshold flow rates essential to a horizontal gravel pack completion, the screen flow area is insufficient for supporting the fluidized gravel transport.

Increasing the circulation flow area of a subliner screen by quantities that by most, would be considered adequate, would also compromise the gravel retention quality of the screen. It is, therefore, an object of the present invention to provide such an increase flow area for the gravel packing interval. Correspondingly, it is an object of the invention to provide a means for closing the auxiliary flow area after the gravel packing process is completed.

SUMMARY OF THE INVENTION

The present invention addresses these objectives and others that will become apparent from the detailed description to follow. In brief, however, large flow area apertures are provided in screen base pipe, preferably near the pipe joint ends. Underlying these large flow apertures within the base pipe bore is a malleable material sleeve. The sleeve is positioned with an outside diameter that is smaller than the inside diameter of the base pipe bore by a differential sufficient to provide a fluid flow annulus of adequate circulation flow area. One axial end of the sleeve is flared or flanged to provide a radial rim that projects radially past the inside diameter of the base pipe. When adjacent base liner pipe joints are assembled by a threaded pipe coupling, the outer rim elements of the sleeve flange are clamped between the contiguous pipe ends to structurally support and confine the sleeve. Alternatively, the rim of the sleeve flare may be welded to the internal bore of the base pipe.

Near the "free" end of the sleeve opposite from the flange, an O-ring sealing element is provided around the sleeve outer perimeter.

The screen pipe is set with the sleeve annulus open to the large flow area apertures. After the gravel pack is placed around the screen, the large flow area apertures are closed by swaging the sleeve radially out against the inner bore wall of the base pipe. Such external radial swaging presses the sleeve O-ring seal against the pipe borewall to seal the annulus and thereby seal the large flow area apertures from the base pipe liner bore.

The sleeve swaging procedure may be carried out by one of several types of swaging tools. One example of a suitable swaging tool includes a fluid expansible element that is attached to a completion tool string or coiled tubing. The expansible element is similar to an expandable, well annulus packer that expands to seal the annulus of a wellbore around an internal tube. Highly pressurized fluid pressure developed at the wellhead and delivered down the completion string tube bore expands the swaging tool within the sleeve.

Another example of a swaging tool type that is suitable for the present invention is a conical or spherical shaped material forming tool that is releasably secured within a casing end-shoe. The cross-sectional diameter of the forming tool is sized in appropriate correspondence with the desired internal diameter of the expanded sleeve. An appropriate connection tool is attached to the end of the well completion tube. When timely, the completion tube is lowered through the sleeve opening for a bayonet connection with the swaging tool. Withdrawal of the completion tube draws the larger diameter swaging tool through the smaller sleeve opening thereby stretching the sleeve inside diameter.

A third suitable swaging tool type comprises a tapered mandrel within a collet element. The swage is attached to the completion string and is in a collapsed alignment while descending downhole. Upon reversal of the completion string travel direction, the internal mandrel is shifted axially relative to the collet thereby expanding the collet fingers.

BRIEF DESCRIPTION OF THE DRAWINGS

A detailed description of the invention following hereafter refers to the several figures of the drawings wherein like reference characters in the several figures relate to the same or similar elements throughout the several figures and.

DESCRIPTION OF THE PREFERRED EMBODIMENTS

Figure 1:
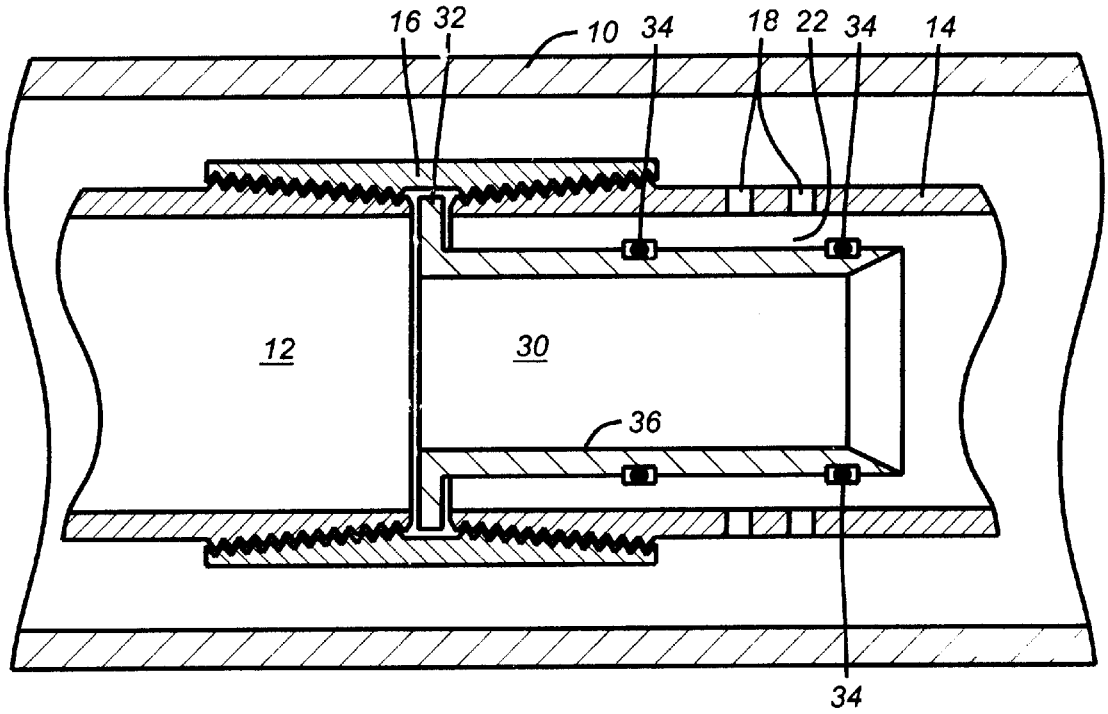
FIG. 1 is a longitudinal section of the invention as initially placed in a well.

The utility environment of this invention is typified by a well bore that is normally initiated from the earth's surface in a vertical direction. By means and procedures well known to the prior art, the vertical well bore may be continuously transitioned into a horizontal bore orientation as desired for bottom hole location or the configuration of the production zone. Usually, a portion of the borehole is internally lined by steel casing pipe 10 which is set into place by cement in the annulus between the borehole wall and outer surface of the casing 10.

Valuable fluids such as petroleum, natural gas and in some cases, water, held within a production zone are efficiently conducted to the surface for transport and refining through a production tubing string, not shown. Herein the term "fluid" is given its broadest meaning to include liquids gases, mixtures and plastic flow solids. The production string is, substantially, an open end pipe set within a casing liner 12.

It is also traditional to assemble the casing liner from a plurality of threaded pipe joints joined by couplings 16. In the vicinity of the production zone, the casing liner may comprise one or more screen sections 14. Often, the screen sections 14 are pipe joints having numerous slits or slotted openings through the pipe wall of the screen. Screen sections in the present invention may also include a multiplicity of flow area enlargement apertures 18. Preferably, the flow enhancement apertures 18 are located proximate of the ends of the screen joint.

Figure 2:
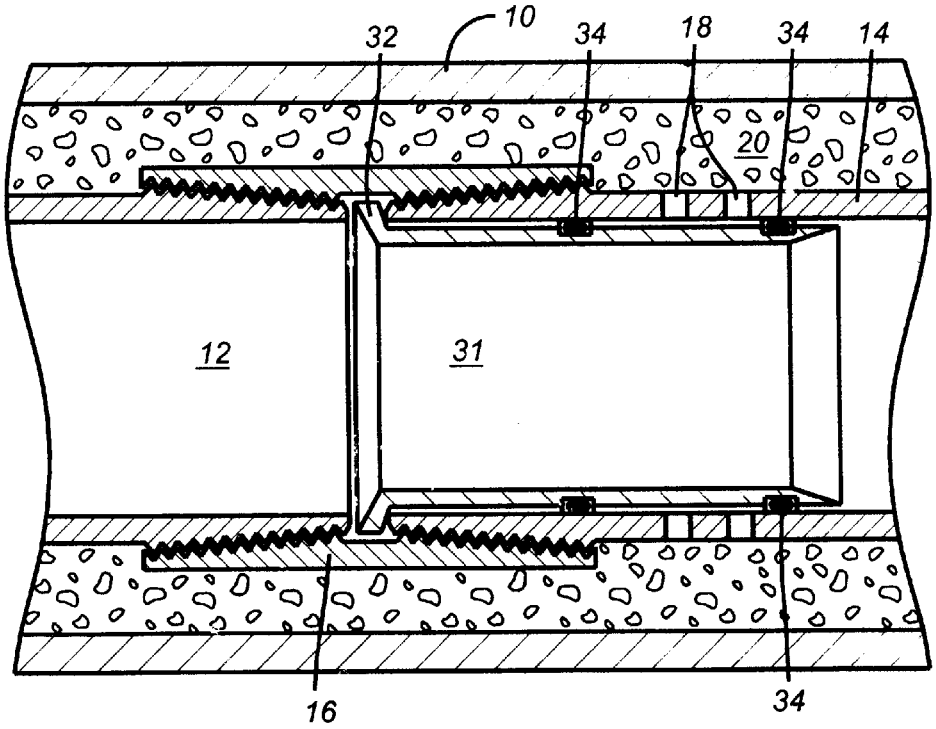
FIG. 2 is a longitudinal section of the invention as operatively completed with a surrounding gravel pack and expanded sleeve closure.

In reference to FIG. 2, the flow enhancement apertures 18 facilitate the placement of gravel packing 20 in the annulus between the inner wall of the casing 10 and the outer wall of the liner 12. As the gravel packing procedure 10 advances, the fluid carrier medium of the gravel packing is retrieved for recirculation through the liner screen slots and flow enlargement apertures 18 into the interior of the casing liner 12 and, ultimately, into a completion string tube for transport to the surface.

After the gravel packing procedure is completed, it is desirable for the apertures 18 to be closed. The large flow area of these apertures is sufficient to permit some gravel pack transport fluid to pass the screens and thereby frustrate the filter and screen objectives. The present invention facilitates such closure of the apertures 18.

Shown in FIG. 1, the invention includes a flanged sleeve 30 that is positioned within the liner pipe screen 14. Preferably, the sleeve extends axially within the screen pipe to lie along and adjacent to the apertures 18. As initially assembled for downhole placement, the sleeve is given a reduced outside diameter relative to the inside diameter of the casing bore to provide a flow annulus 22 for the gravel pack carrier fluid received through the apertures 18. To secure the axial position of the sleeve within a desired perimeter region along the casing bore length, the sleeve 30 is formed to include an integral flange 32 turned into a substantially transverse plane. In one embodiment of the invention, the flange 32 is seated between the substantially transverse planes of end butts respective to adjacent liner joints 12 and 14. Another embodiment of the invention may weld the flange 52 to the inside borewall of the screen joint 14 within the desired perimeter region.

Around the outside perimeter of the sleeve 30 are a pair of O-ring seals 34. These seals 34 are positioned within a transverse plane along the axial length of the sleeve 30 to confine the apertures 18 between them when the sleeve 30 is expanded against the inside wall surface of the liner pipe 14. Depending on the sleeve fabrication accuracy and finish, it may be possible to omit the O-ring seal most proximate of the flange 32 in reliance on the flange integrity for sealing that flow direction along the annulus 22.

Materially, the sleeve may be fabricated of a thin, malleable material such as mild steel. The sleeve material composition and thickness should permit sufficient plastic flow deformation in the tensile hoop mode as will tolerate a magnitude of radial stretching sufficient to close the annulus 22. Additionally, the required expansion should not require excessive driving force.

Figure 3:
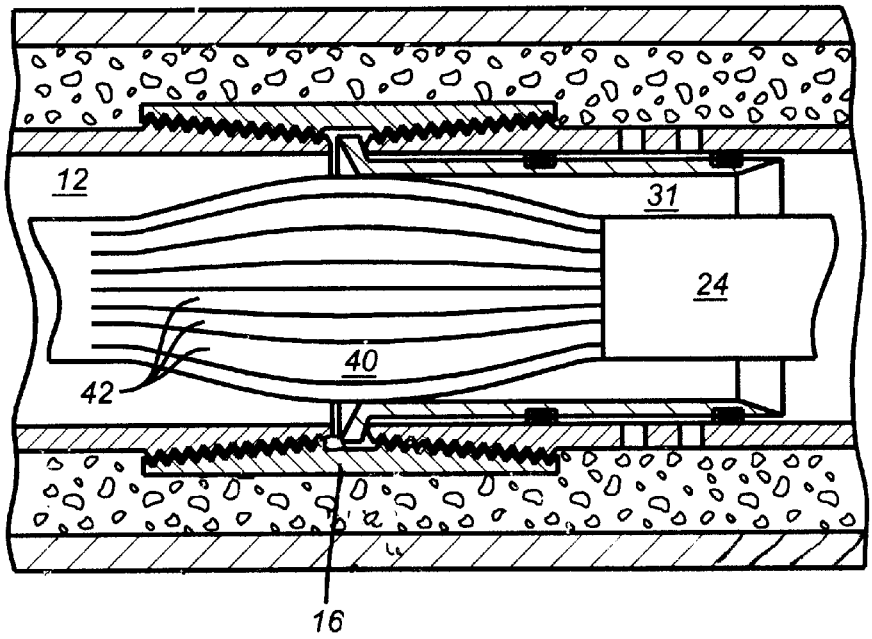
FIG. 3 is a longitudinal section of the invention illustrating a collet swage.
Figure 5:
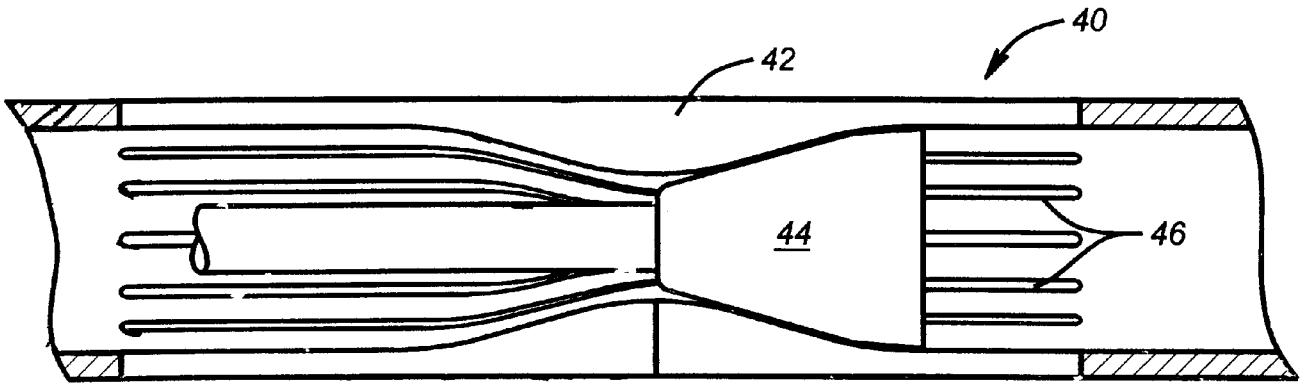
FIG. 5 is a longitudinal section of the invention illustrating the collet swage in the collapsed condition.
Figure 6:
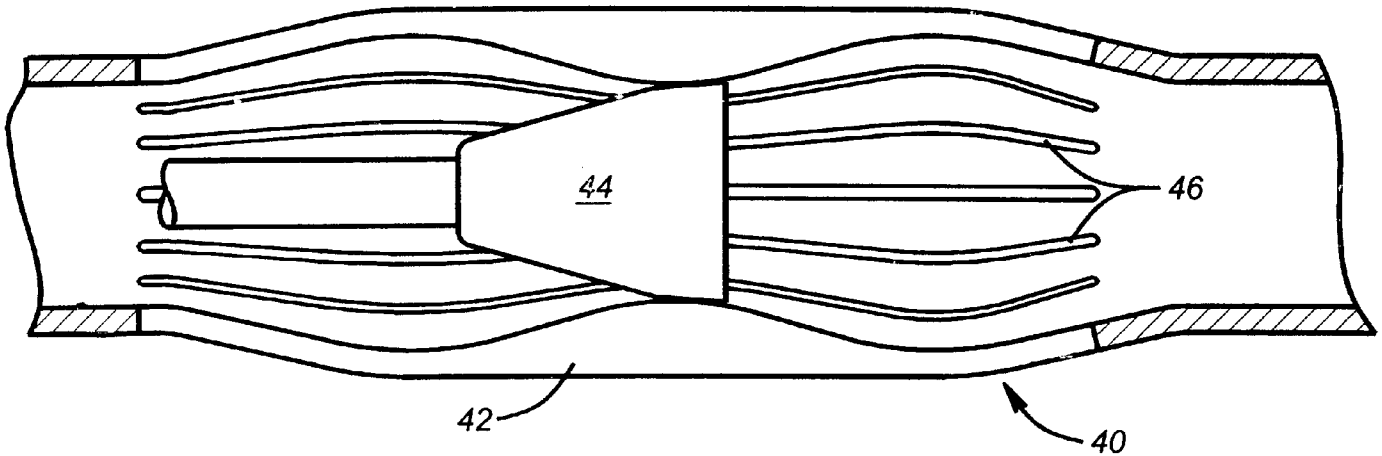
FIG. 6 is a longitudinal section of the invention illustrating the collet swage in the expanded condition.

Material forming of the nature described herein is generally characterized as "swaging." A most fundamental form of swaging, as applied to the present invention, may include a tapered end swaging tool that is removably set, by means of a shear pin, for example, in the foot joint of the liner string. The upper end of the swaging tool comprises an overshot thread, male or female. At the distal end of the completion string, is an opposite gender overshot thread. The casing liner is set with the sleeve 30 in place (one or more sleeves) and the swaging tool pinned in a foot joint socket. When timely, the completion string is lowered to mesh the respective overshots. This overshot joint meshes the swaging tool with the completion string. When meshed, the completion string is drawn out to shear the tool anchoring pins. Continued draw of the completion string pulls the swaging tool from its socket, through the internal barrel 36 of at least one and usually several aperture closure sleeves to expand the sleeve O.D. and draw the swaging tool from its socket FIGS. 3, 5 and 6 illustrate a second form of suitable swaging tool which comprises a collet swage 40. The collet includes a profiled interior 42 and a plurality of longitudinal slits 46 distributed around the perimeter for delineating a plurality of collet fingers 42. Internally, a tapered face, conical mandrel 44 is axially displaced against the finger cam profiles 42 thereby spreading the outside finger perimeter. The axial shift of the mandrel 44 may be selectively activated by pump pressure or by a draw on the completion string 24. Operatively, the collet swage is lowered into the well with other completion tools to a depth below the lowest closure sleeve 30. Here, the collet is activated to expand the fingers when appropriate and drawn through the respective sleeve barrels 36.

Figure 4:
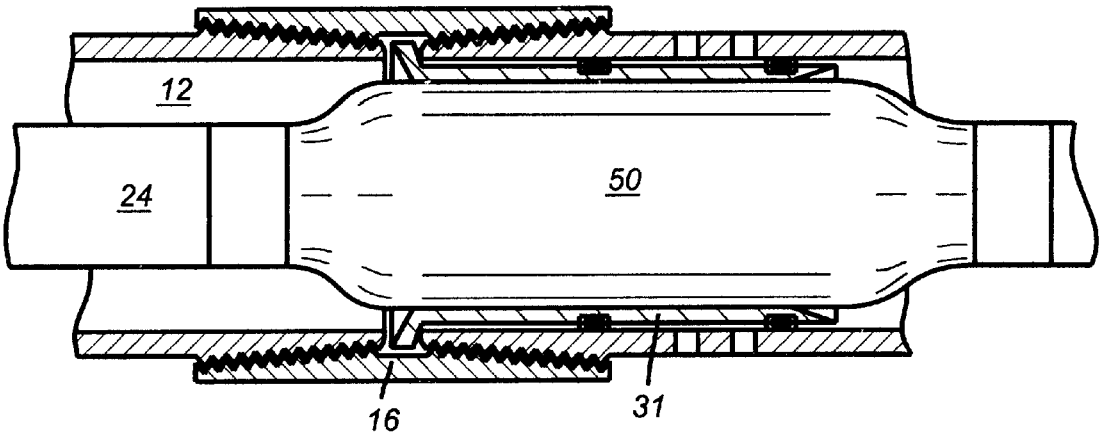
FIG. 4 is a longitudinal section of the invention illustrating a swage that is expanded by fluid pressure.

A third swaging tool embodiment may comprise a expandible packer type of apparatus 50 that is positioned in the well when collapsed and expanded by pump pressure as illustrated by FIG. 4.

Figure 7:
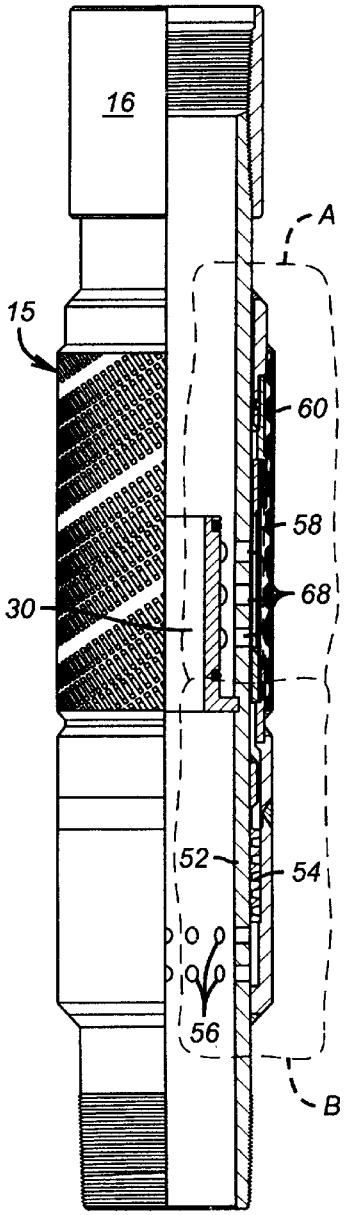
FIG. 7 is a longitudinal quarter section of a sand screen section embodied with the present invention.
Figure 8:
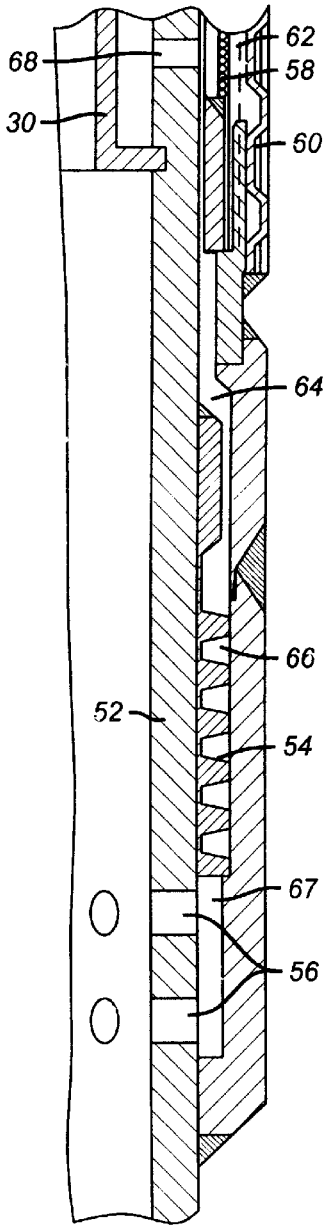
FIG. 8 is an enlarged detail of the FIG. 7 region B.
Figure 9:
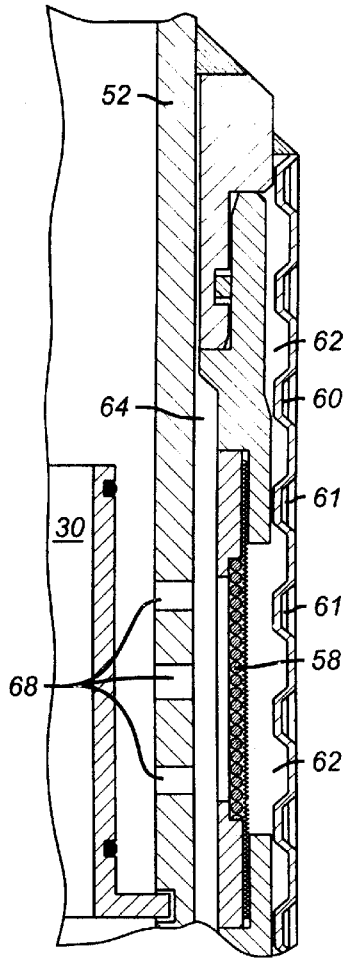
FIG. 9 is an enlarged detail of the FIG. 7 region A.

FIGS. 7 through 9 illustrate more complex equipment such as that having utility for completing an extremely long, horizontal well bore. Completions of this description are known to demonstrate variations in production rate along the wellbore length. Typical among the problems caused by production rate variations along a well bore length is premature water or gas production. For example, if migration of the in situ crude toward the wellbore is driven by a water table, uncontrolled production from a relatively small zone will allow the source water to displace the crude from that zone before the remainder of the production zone. Consequently, water will be the production fluid from the uncontrolled zone in lieu of the desired crude. Additional production fluid processing is required to separate the water from the crude.

To delay the described consequences, flow restrictors are strategically placed along the wellbore where necessary to equalize the production rate along the wellbore length. Unfortunately, the presence of flow restrictors in a production screen greatly complicates the process of gravel packing the wellbore around the production screens. The present invention offers a solution to the dilemma by providing an unrestricted flow route for the sand packing medium that by-passes the production flow restriction channel. After the sand pack is complete, the by-pass flow route is closed.

Referring to FIG. 7, a representative production screen 15 may include two or more screen stages. In this example, the screen 15 includes a helically wrapped and welded strip sheet 60 having a stamped pattern of perforations 61. The perforated sheet screen 60 encompasses an internal wound wire screen 58. With respect to FIGS. 8 and 9, an outer flow chamber 62 may separate the perforated sheet screen 60 from the wire wound screen 58. Between the wire wound screen 58 and the O.D. surface of the base pipe 52 is an inner flow chamber 64.

The inner flow chamber 64 axially connects with a helically wrapped flow restriction channel 66 which empties into a plenum chamber 67. Production ports 56 channel production fluid flow from the plenum chamber 67 into the internal bore of the base pipe 52.

As modified by the present invention, the base pipe wall 52 is also perforated by sand packing ports 68 between the inner chamber 64 and the internal flow bore of the base pipe 52 thereby shunting the flow restriction channel 66. When the well completion gravel pack is initially placed around the screen 15, the essential heavy flows of sand suspension medium through the screens 58 and 60 by-pass the flow restriction channel 66 and enter the base pipe 52 bore directly from the inner chamber 64.

Although the invention has been described in terms of certain preferred embodiments, it will become apparent to those of ordinary skill in the art that modifications and improvements can be made to the inventive concepts herein without departing from the scope of the invention, the embodiments shown herein are merely illustrative of the inventive concepts and should not be interpreted as limiting the scope of the invention.

What is claimed is:

1. An apparatus for closing a fluid flow aperture through a well pipe wall between an internal flowbore of said pipe and an external pipe environment, said apparatus comprising a substantially cylindrical sleeve formed of malleable material, said sleeve being disposed substantially coaxially within said flowbore and adjacent said aperture, one end of said sleeve being radially flared with an outer rim of the flare being secured to said pipe wall to provide an annular space between said sleeve and said pipe wall from said flare to channel fluid flow through said aperture, along said annulus and into said flowbore, a perimeter sealing element disposed between said sleeve and said pipe wall to substantially seal said annulus from said aperture flow when said sleeve is expanded against said pipe wall.

2. An apparatus as described by claim 1 wherein the outer rim of said sleeve flare is welded to said pipe wall.

3. An apparatus as described by claim 1 wherein the outer rim of said sleeve flare is secured between adjacent casing joints.

4. An apparatus as described by claim 1 wherein said perimeter sealing element comprises an O-ring positioned around the outer perimeter of said sleeve.

5. A well production sand screen having an outer screen element enclosing a base pipe, said outer screen element having particle size restricted flow orifices to channel a production flow of well fluid past said outer screen element into an internal flow chamber between said outer screen and said base pipe, first and second apertures through said base pipe between said internal flow chamber and a central flow bore, and a malleable material sleeve in substantially parallel alignment with said flow bore adjacent said first aperture, said sleeve having an out-turned flange secured to said base pipe to form an annular flow space between said sleeve and said base pipe whereby an expanded deformation of said sleeve obstructs fluid flow through said first aperture.

6. A well production screen as described by claim 5 wherein said first and second apertures are separated along said internal flow chamber by a flow restriction channel whereby fluid flow through said outer screen is required to traverse said flow restriction to enter said flow bore when said sleeve is deformed.

7. A well production screen as described by claim 6 wherein said flow restriction channel is a helically wound flow course.

8. A well production screen as described by claim 5 wherein said sleeve includes sealing elements between said sleeve and said base pipe whereby said sleeve is deformed against said sealing elements to seal said first aperture from flow therethrough.

9. A method of controlling the production of well fluid comprising the steps of:

providing a fluid production tube having a fluid flow bore within a peripheral wall with at least one fluid flow aperture;

providing a tubular sleeve section having an outside diameter less than an inside diameter of said fluid flow bore, said sleeve section being radially flared to provide an outer rim;

securing said tubular sleeve to said production tube within said flow bore and within a perimeter region that is axially displaced from said aperture, whereby the outer rim is secured to said peripheral wall within said perimeter region, and whereby a sleeve continuation from said perimeter region provides an annular fluid flow space from said aperture into said flow bore in one axial direction; and suspending said production tube within a well for the production of well fluid flow through said aperture.

10. A method of controlling well fluid production as described by claim 9 wherein said well fluid production through said aperture is terminated by radial expansion of said sleeve against said peripheral wall.

11. A method of controlling well fluid production as described by claim 9 wherein a portion of said sleeve section is radially expanded to engage said peripheral wall within said perimeter region.

12. A method of controlling well fluid production as described by claim 9 wherein said sleeve section is radially flared with an outer rim of the flare secured to said peripheral wall within in said perimeter region.

13. A method of controlling well fluid production as described by claim 9 wherein said outer rim is welded to said peripheral wall.

14. A method of controlling well fluid production as described by claim 9 wherein said outer rim is confined between adjacent ends of coupled pipe sections.

15. A method of closing a fluid flow aperture in a well pipe comprising the steps:

providing a pipe section having a flowbore within a peripheral wall of said pipe section and at least one fluid flow aperture through said peripheral wall;

securing a malleable sleeve to the inside of said pipe section at an attachment position by welding said sleeve to the peripheral wall, said sleeve being aligned to extend axially, from said attachment position, within said flowbore along said wall adjacent to said aperture, an outside diameter of said sleeve from said attachment position being less than an inside diameter of said wall to provide a fluid flow annulus between said sleeve and said peripheral wall for fluid flow between said aperture and said flowbore;

positioning a sleeve expansion tool in said pipe section to align with said sleeve;

operating said sleeve expansion tool in said pipe section to align with said sleeve;

operating said sleeve expansion tool to radially expand said sleeve to seal said annulus from fluid flow through said aperture; and removing said expansion tool from said pipe section.

16. A method as described by claim 15 wherein said sleeve expansion tool is initially secured to a second pipe section below a first section for positioning in said wellbore, said sleeve expansion tool being selectively attached to a completion tool and detached from said pipe section for sleeve expansion.

17. A method as described by claim 15 wherein said sleeve expansion tool is combined with a well completion tool for positioning in said sleeve secured pipe section.

18. A method of closing a fluid flow aperture in a well pipe comprising the steps:

providing a pipe section having a flowbore within a peripheral wall of said pipe section and at least one fluid flow aperture through said peripheral wall;

securing a malleable sleeve to the inside of said pipe section at an attachment position by clamping said sleeve between adjacent pipe sections, said sleeve being aligned to extend axially, from said attachment position, within said flowbore along said wall adjacent to said aperture, an outside diameter of said sleeve from said attachment position being less than an inside diameter of said wall to provide a fluid flow annulus between said sleeve and said peripheral wall for fluid flow between said aperture and said flowbore;

positioning a sleeve expansion tool in said pipe section to align with said sleeve;

operating said sleeve expansion tool in said pipe section to align with said sleeve;

operating said sleeve expansion tool to radially expand said sleeve to seal said annulus from fluid flow through said aperture; and removing said expansion tool from said pipe section.

19. A method as described by claim 18 said sleeve expansion tool is initially secured to a second pipe section below a first section for positioning in said wellbore, said sleeve expansion tool being selectively attached to a completion tool and detached from said pipe section for sleeve expansion.

20. A method as described by claim 18 wherein said sleeve expansion tool is combined with a well completion tool for positioning in said sleeve secured pipe section.

21. A method of closing a fluid flow aperture in a well pipe comprising the steps:

providing a pipe section having a flowbore within a peripheral wall of said pipe section and at least one fluid flow aperture through said peripheral wall;

securing a malleable sleeve to the inside of said pipe section at an attachment position, said sleeve being aligned to extend axially, from said attachment position, within said flowbore along said wall adjacent to said aperture, an outside diameter of said sleeve from said attachment position being less than an inside diameter of said wall to provide a fluid flow annulus between said sleeve and said peripheral wall for fluid flow between said aperture and said flowbore;

positioning a sleeve expansion tool in said pipe section to align with said sleeve, said sleeve expansion tool being combined with a well completion tool for positioning in said sleeve secured pipe section, said sleeve expansion tool also having a reduced diameter for positioning in said sleeve secured pipe section below said sleeve and being expanded to a greater diameter when drawn back through said sleeve;

operating said sleeve expansion tool in said pipe section to align with said sleeve;

operating said sleeve expansion tool to radially expand said sleeve to seal said annulus from fluid flow through said aperture; and removing said expansion tool from said pipe section.

22. The method as described by claim 21 wherein said sleeve expansion tool is expanded against said sleeve by internal fluid pressure.

* * * * *